US009228316B2

(12) United States Patent
Staade et al.

(10) Patent No.: US 9,228,316 B2
(45) Date of Patent: Jan. 5, 2016

(54) MOTOR GRADER CIRCLE DRIVE ASSEMBLY

(71) Applicant: Deere & Company, Moline, IL (US)

(72) Inventors: Dustin T. Staade, Dubuque, IA (US); Nathan J. Horstman, Durango, IA (US)

(73) Assignee: DEERE & COMPANY, Moline, IL (US)

( * ) Notice: Subject to any disclaimer, the term of this patent is extended or adjusted under 35 U.S.C. 154(b) by 251 days.

(21) Appl. No.: 13/788,262

(22) Filed: Mar. 7, 2013

(65) Prior Publication Data

US 2014/0251648 A1 Sep. 11, 2014

(51) Int. Cl.
*E02F 3/84* (2006.01)
*E02F 3/76* (2006.01)

(52) U.S. Cl.
CPC ..... *E02F 3/844* (2013.01); *E02F 3/764* (2013.01); *E02F 3/7654* (2013.01); *E02F 3/7668* (2013.01)

(58) Field of Classification Search
CPC ..... E02F 3/764; E02F 3/7668
USPC ..... 172/792, 796
See application file for complete search history.

(56) References Cited

U.S. PATENT DOCUMENTS

| | | | | | |
|---|---|---|---|---|---|
| 1,844,058 | A | * | 2/1932 | Dean | 172/796 |
| 2,928,381 | A | * | 3/1960 | MacDonald | 91/186 |
| 3,028,699 | A | * | 4/1962 | Greeley | 172/796 |
| 3,712,384 | A | * | 1/1973 | Fisher | 172/796 |
| 3,721,303 | A | * | 3/1973 | Hanser | 172/792 |
| 3,924,689 | A | * | 12/1975 | Manor | 172/799 |
| 3,989,112 | A | * | 11/1976 | Cole et al. | 172/796 |
| 4,161,987 | A | * | 7/1979 | Tolmer | 172/791 |
| 4,340,119 | A | * | 7/1982 | MacDonald | 172/789 |
| 6,129,156 | A | * | 10/2000 | Boast et al. | 172/4.5 |
| 6,758,286 | B2 | | 7/2004 | Walker | |

* cited by examiner

*Primary Examiner* — Thomas B Will
*Assistant Examiner* — Joel F. Mitchell

(57) ABSTRACT

The present disclosure provides a circle drive assembly for a motor grader. The circle drive assembly includes a circle member being rotatable about a rotation axis, a first hydraulic cylinder and a second hydraulic cylinder for rotatably driving the circle member, and a first and second coupling mechanisms. The first hydraulic cylinder has a first end coupled to the first coupling mechanism and the second hydraulic has a second end coupled to the second coupling mechanism. The first coupling mechanism and second coupling mechanism can be controllably moved between a clamped position and an unclamped position. The first hydraulic cylinder rotatably drives the circle member when the first coupling mechanism is in the clamped position and the second hydraulic cylinder rotatably drives the circle member when the second coupling mechanism is in the clamped position.

18 Claims, 4 Drawing Sheets

MOTOR GRADER CIRCLE DRIVE ASSEMBLY

FIELD OF THE DISCLOSURE

The present disclosure relates to a motor grader, and in particular to a circle drive assembly of a motor grader.

BACKGROUND OF THE DISCLOSURE

Work vehicles, such as a motor grader, can be used in construction and maintenance for creating a flat surface. When paving a road, a motor grader can be used to prepare a base foundation to create a wide flat surface for asphalt to be placed on. A motor grader can include two or more axles, with an engine and cab disposed above the axles at the rear end of the vehicle and another axle disposed at the front end of the vehicle. A blade is attached to the vehicle between the front axle and rear axle.

Motorgraders include a drawbar assembly attached near the nose of the grader which is pulled by the grader as it moves forward. The drawbar rotatably supports a circle drive member at a free end of the drawbar and the circle drive member supports a work implement such as the blade. The angle of the work implement beneath the drawbar can be adjusted by the rotation of the circle drive member relative to the drawbar assembly.

In some conventional motorgraders, the circle drive members are supported by a series of bearings attached to the drawbar and the circle drive member includes a series of gear teeth disposed to the exterior circle member or disposed to the interior of the circle member. These gear teeth cooperate with one or more drive gears associated with drive motors attached to the drawbar. In other conventional motorgraders, a worm driven gear box can be mounted to a draft frame of the grader and which rotates pinion gears which mesh with the large ring gear of the circle drive member.

In conventional motor graders, the use of a gear box has limitations. For instance, the gear box can be inefficient and thereby limiting the amount of available power to the drive the work implement. Some alternative solutions have incorporated a hydraulic cylinder, which is more efficient than the gear box. The use of multiple hydraulic cylinders, however, has limitations as well since the cylinders can only rotate the circle so far before the cylinders either crossover one another or cannot continue rotation. Occasionally, the cylinders are not operating in optimal positions and thus need to be repositioned during operation to achieve their full mechanical advantage over the conventional gear box arrangement.

Therefore, a need exists for a circle drive assembly of a motor grader to be driven by hydraulic cylinders. In addition, a need exists for the capability of repositioning the hydraulic cylinders to achieve the full 360° rotation of the circle drive assembly.

SUMMARY

In an exemplary embodiment of the present disclosure, a circle drive assembly is provided for a motor grader. The circle drive assembly includes a circle member being rotatable about a rotation axis, a first hydraulic cylinder and a second hydraulic cylinder for rotatably driving the circle member, and first and second coupling mechanisms. The first hydraulic cylinder has a first end coupled to the first coupling mechanism and the second hydraulic has a second end coupled to the second coupling mechanism. The first coupling mechanism and second coupling mechanism can be controllably moved between a coupled position and an uncoupled position. The first hydraulic cylinder rotatably drives the circle member when the first coupling mechanism is in the coupled position and the second hydraulic cylinder rotatably drives the circle member when the second coupling mechanism is in the coupled position.

In one aspect, each of the first coupling mechanism and second coupling mechanism comprises a plurality of calipers. In another aspect, each coupling mechanism is hydraulically controlled between the coupled and uncoupled positions. In a different aspect, the first end and second end move relative to the circle member in the uncoupled position. In a further aspect, the first end and second end are structured to move in a substantially circular manner relative to the rotation axis as the first and second hydraulic cylinders are actuated. Moreover, the first end is structured to be moved relative to the circle member from a first location to a second location along the circumference of the circle member when the first coupling mechanism is in the uncoupled position and the second end is structured to be moved relative to the circle member from a first location to a second location along the circumference of the circle member when the second coupling mechanism is in the uncoupled position.

In a related aspect, the circle member is structured to be rotatably driven in a clockwise or counterclockwise direction. In addition, each coupling mechanism comprises a first structure and a second structure coupled to one another, the first structure being disposed at least partially above the circle member and the second structure being disposed at least partially beneath the circle member, where the circle member includes a first raised portion that is accommodated within a recess defined in the second structure when the coupling mechanism is in at least the clamped position.

In another embodiment, a motor grader includes a frame for supporting a plurality of wheels, a work implement supported by the frame and adapted to perform a desired operation, a controller, and a circle drive assembly for controlling the work implement. The circle drive assembly includes a circle member being rotatable about a rotation axis, a first hydraulic cylinder and a second hydraulic cylinder for rotatably driving the circle member. The first hydraulic cylinder has a first end coupled to the frame and a second end opposite the first end. The second hydraulic cylinder has a first end coupled to the frame and a second end opposite the first end. A first coupling mechanism is coupled to the second end of the first hydraulic cylinder, where the first coupling mechanism is controllably actuated between an engaged position and a disengaged position. A second coupling mechanism is coupled to the second end of the second hydraulic cylinder, where the second coupling mechanism is controllably actuated between an engaged position and a disengaged position. The first hydraulic cylinder rotatably drives the circle member when the first coupling mechanism is in the engaged position and the second hydraulic cylinder rotatably drives the circle member when the second coupling mechanism is in the engaged position.

In one aspect, a rotation sensor is electrically coupled to the controller such that the rotation sensor is adapted to detect rotational movement of the circle member. A first position sensor and a second position sensor are electrically coupled to the controller. The first position sensor is adapted to detect a stroke length and position of the first hydraulic cylinder and the second position sensor is adapted to detect a stroke length and position of the second hydraulic cylinder. The controller is structured to receive electrical signals from the rotation sensor, first position sensor, and second position sensor, and based on said signals, actuate one or both of the first and second coupling mechanisms.

In another aspect, the second ends of the first and second hydraulic cylinders move relative to the circle member in the disengaged position. In a different aspect, the first end and second end are structured to move in a substantially circular manner relative to the rotation axis as the first and second hydraulic cylinders are actuated. In a further aspect, each of the first coupling mechanism and second coupling mechanism comprises a plurality of calipers.

In one form of this embodiment, the second end of the first hydraulic cylinder is structured to be moved relative to the circle member from a first location to a second location along the circumference of the circle member when the first coupling mechanism is in the disengaged position and the second end of the second hydraulic cylinder is structured to be moved relative to the circle member from a first location to a second location along the circumference of the circle member when the second coupling mechanism is in the disengaged position. In another form thereof, the circle member is structured to be rotatably driven 360° in a clockwise or counterclockwise direction. In a different form, each coupling mechanism comprises a first structure and a second structure coupled to one another, the first structure being disposed at least partially above the circle member and the second structure being disposed at least partially beneath the circle member, where the circle member includes a first raised portion that is accommodated within a recess defined in the second structure when the coupling mechanism is in at least the engaged position.

In a different embodiment, a method is provided for operably controlling a circle drive assembly of a motor grader. The circle drive assembly includes a circle member rotatable about a rotation axis, a first hydraulic cylinder having a first end, a second hydraulic cylinder having a second end, a first coupling mechanism coupled to the first end, a second coupling mechanism coupled to the second end, a rotation sensor, a first position sensor, and a second position sensor. The method includes detecting a position of the circle member with the rotation sensor, detecting a stroke length of the first hydraulic cylinder and the second hydraulic cylinder with the first position sensor and the second position sensor, sending electrical signals to a vehicle controller based on the detected position of the circle member and stroke lengths of the first hydraulic cylinder and second hydraulic cylinder, coupling the first coupling mechanism to the circle member, actuating the first hydraulic cylinder to change its stroke length, and rotatably moving the circle member about the rotation axis.

In one aspect, the method includes receiving an electrical signal from the vehicle controller, coupling the first coupling mechanism and the second coupling mechanism to the circle member, and rotatably moving the circle member about the rotation axis by the first hydraulic cylinder and the second hydraulic cylinder. In another aspect, the method includes receiving an electrical signal from the vehicle controller, decoupling the first coupling mechanism from the circle member, and moving the decoupled first coupling mechanism from a first location to a second location along the circumference of the circle member such that the decoupled first coupling mechanism moves relative to the circle member. In a different aspect, the method includes (a) coupling the first coupling mechanism and second coupling mechanism to the circle member, (b) rotating the circle member about the rotation axis a distance less than 360°, (c) decoupling at least one of the first and second coupling mechanisms from the circle member, (d) repositioning the at least one decoupled coupling mechanism about the circumference of the circle member, and (e) repeating steps (a)-(d) one or more times to rotatably move the circle member 360° about the rotation axis in a clockwise or counterclockwise direction.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
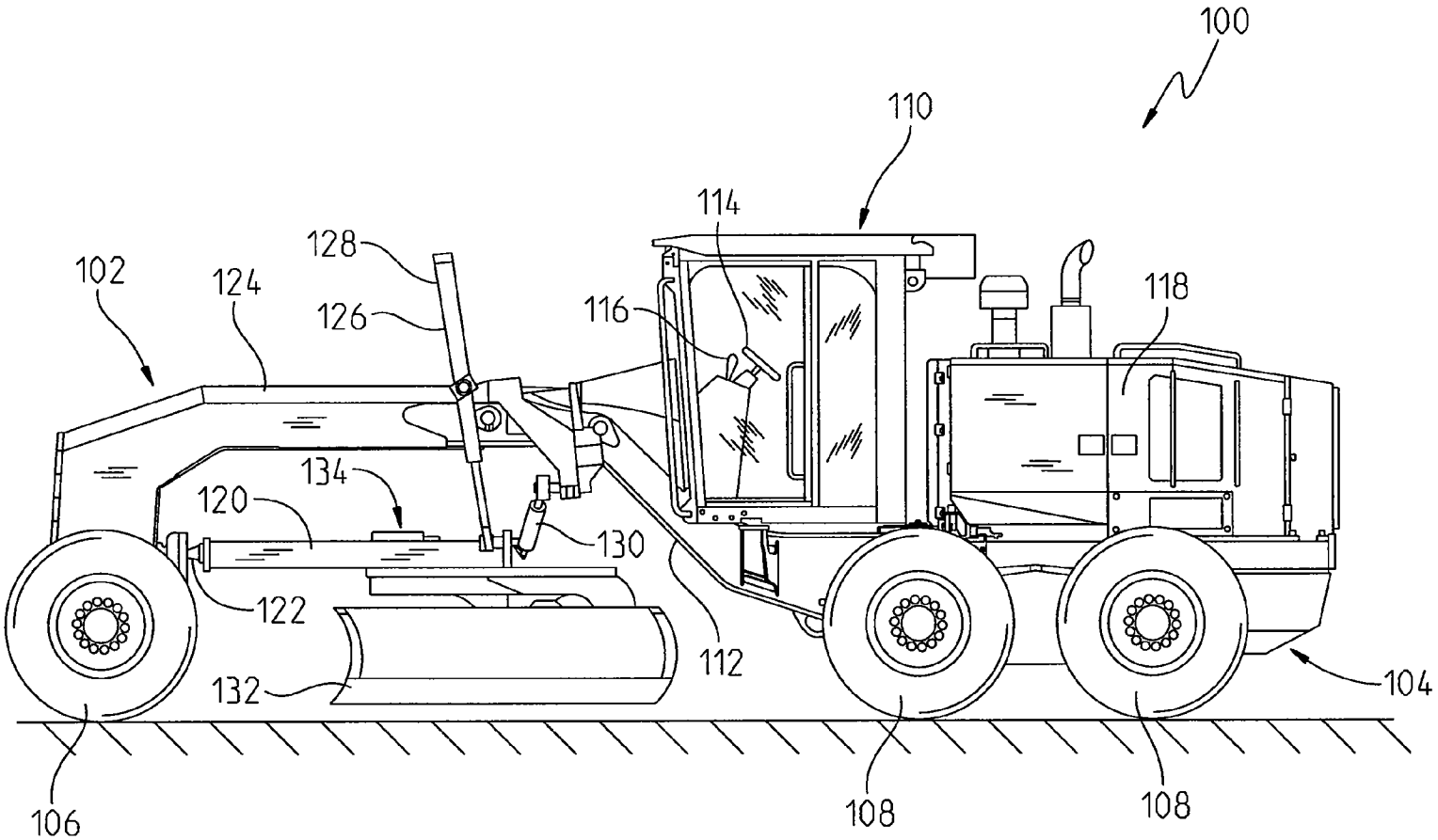
Fig. 1 (Prior Art)
FIG. 1 is a side view of a motor grader.

Referring to FIG. 1, an exemplary embodiment of a machine, such as a motor grader 100, is shown. An example of a motor grader is the 772G Motor Grader manufactured and sold by Deere & Company. As shown in FIG. 1, the motor grader 100 includes front and rear frames 102 and 104, respectively, with the front frame 102 being supported on a pair of front wheels 106, and with the rear frame 104 being supported on right and left tandem sets of rear wheels 108. An operator cab 110 is mounted on an upwardly and forwardly inclined rear region 112 of the front frame 102 and contains various controls for the motor grader 100 disposed so as to be within the reach of a seated or standing operator. In one aspect, these controls may include a steering wheel 114 and a lever assembly 116. An engine 118 is mounted on the rear frame 104 and supplies power for all driven components of the motor grader 100. The engine 118, for example, can be configured to drive a transmission (not shown), which is coupled for driving the rear wheels 108 at various selected speeds and either in forward or reverse modes. A hydrostatic front wheel assist transmission (not shown) may be selectively engaged to power the front wheels 106, in a manner known in the art.

Mounted to a front location of the front frame 102 is a drawbar or draft frame 120, having a forward end universally connected to the front frame 102 by a ball and socket arrangement 122 and having opposite right and left rear regions suspended from an elevated central section 124 of the front frame 102 by right and left lift linkage arrangements including right and left extensible and retractable hydraulic actuators 126 and 128, respectively. A side shift linkage arrangement is coupled between the elevated frame section 124 and a rear location of the drawbar 120 and includes an extensible and retractable side swing hydraulic actuator 130. A blade 132 is coupled to the front frame 102 and powered by a circle drive assembly 134.

Figure 2:
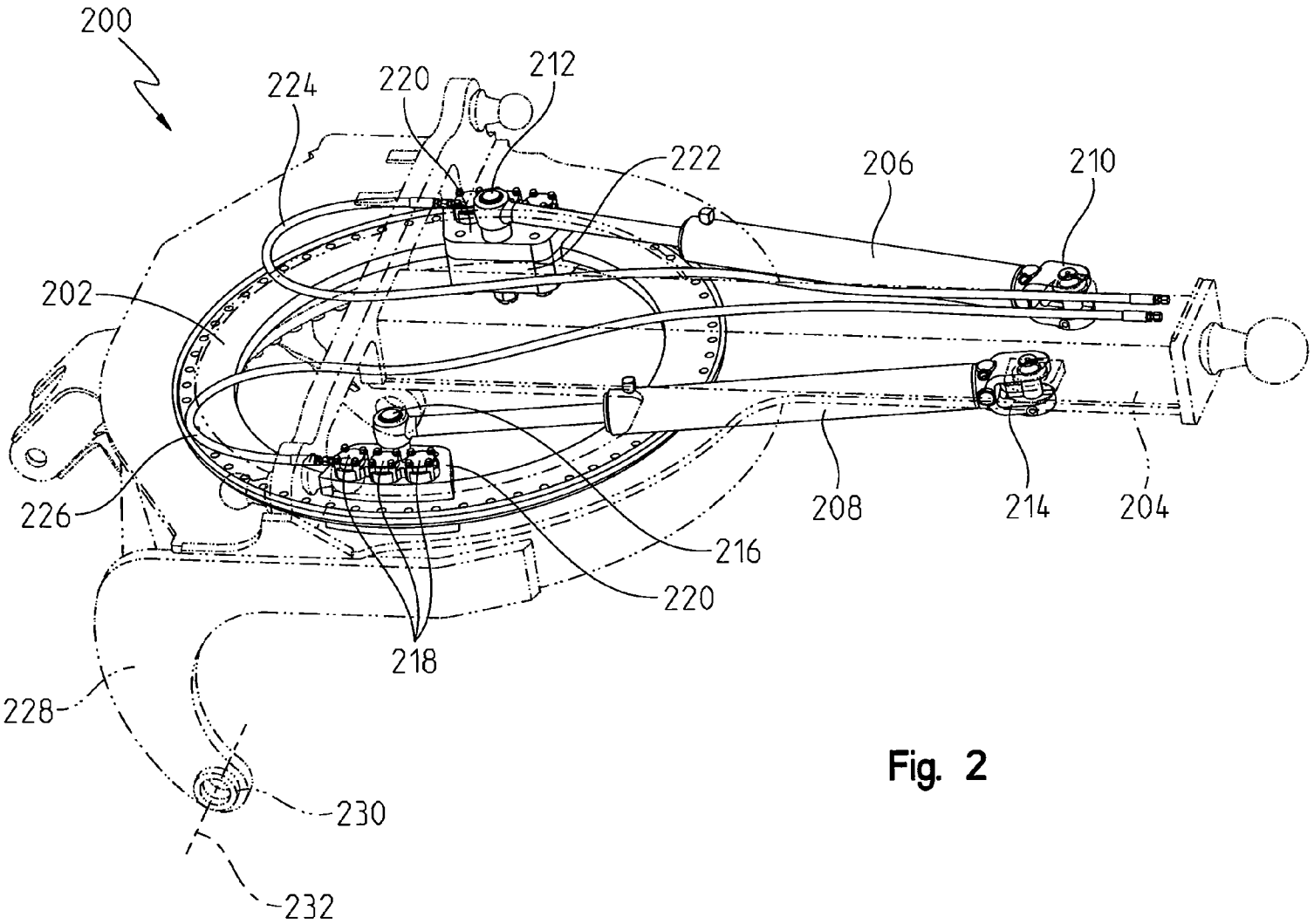
FIG. 2 is a perspective view of an exemplary circle drive assembly of a motor grader.

Referring to FIG. 2, an exemplary embodiment of a circle drive assembly 200 for a motor grader is shown. The circle drive assembly 200 can include a rotatable circle member 202 coupled to a draft frame 204 or drawbar assembly. The circle member 202 can be rotatable about a rotation axis in a clockwise or counterclockwise direction. The draft frame 204 can include a substantially C-shaped frame member or structure 228. The substantially C-shaped frame member or structure 228 can define a pivot axis 232. A tilt frame or other frame element (not shown) can be coupled to the substantially C-shaped frame member or structure 228 at a connection point 230 to allow a motor grader operator to pitch a work implement forwards and backwards. Alternatively, the work implement (e.g., blade) may be directly coupled to the substantially C-shaped member or structure 228.

The circle member 202 can be rotationally-driven by a first hydraulic cylinder 206 and a second hydraulic cylinder 208. The first hydraulic cylinder 206 can be coupled or mounted to the draft frame 204 at a first location 210. The second hydraulic cylinder 208 can be coupled or mounted to the draft frame 204 at a second location 214. Although not shown in FIG. 2, the circle member 202 can be rotationally driven about a rotation axis. In this embodiment, the first location 210 and second location 214 can be disposed substantially equidistant from the rotation axis.

The first hydraulic cylinder 206 can be coupled to the circle member 202 at a third location 212 and the second hydraulic cylinder 208 can be coupled to the circle member 202 at a fourth location. The first location 210 and second location 214 are fixedly coupled to the draft frame 204, whereas the third location 212 and fourth location 216 are movable with respect to the first and second hydraulic cylinders, respectively. Regardless of the position of either hydraulic cylinder, however, the third location 212 and the fourth location 216 are radially spaced from the rotation axis. In other words, the first hydraulic cylinder 206 and second hydraulic cylinder 208 are coupled to the circle member 202 and are substantially equidistantly spaced from the rotation axis (not shown) by the defined radius of the circle member.

Due to the mounting of both hydraulic cylinders to the draft frame 204, the circle member 202 can rotate a limited angular distance before the rods of each hydraulic cylinder begin to interfere or contact one another. Here, if the first hydraulic cylinder 206 is disposed on a first side and the second hydraulic cylinder 208 is disposed on a second side, the control and performance of the circle drive assembly 200 may be best achieved when the third location or connection point 212 is disposed on the first side of the circle member 202 and the fourth location or connection point 216 is disposed on the second side thereof. In any event, it is desirable for the first hydraulic cylinder 206 and second hydraulic cylinder 208 not to interfere or cross over one another during operation.

To achieve desired performance, the first and second hydraulic cylinders can be coupled to a first structure 220 that is disposed at least partially above the circle member 202. In other words, the first hydraulic cylinder 206 couples to the circle member 202 at the third location or connection point 212 that is disposed above the circle member 202. Similarly, the second hydraulic cylinder 208 couples to the circle member 202 at the fourth location or connection point 216 that is disposed above the circle member 202. In addition, a second structure 222 can be disposed at least partially beneath the circle member 202. A plurality of coupling mechanisms 218 can be structurally disposed within the first structure 220 and second structure 222. The plurality of coupling mechanisms 218 can be operably controlled to induce a coupling movement of the first and second structures against the circle member 202. In one non-limiting example, the plurality of coupling mechanisms 218 can be operably similar to brake calipers. In FIG. 2, a first fluid line 224 can hydraulically actuate the plurality of coupling mechanisms 218 disposed on the first side of the circle drive assembly 200 as the first hydraulic actuator 206. Likewise, a second fluid line 226 can hydraulically actuate the plurality of coupling mechanisms 218 disposed on the second side of the circle drive assembly 200 as the second hydraulic actuator 208. The first fluid line 224 and second fluid line 226 can be coupled to a vehicle controller or control valve to actuate the plurality of coupling mechanisms 218.

Figure 3:
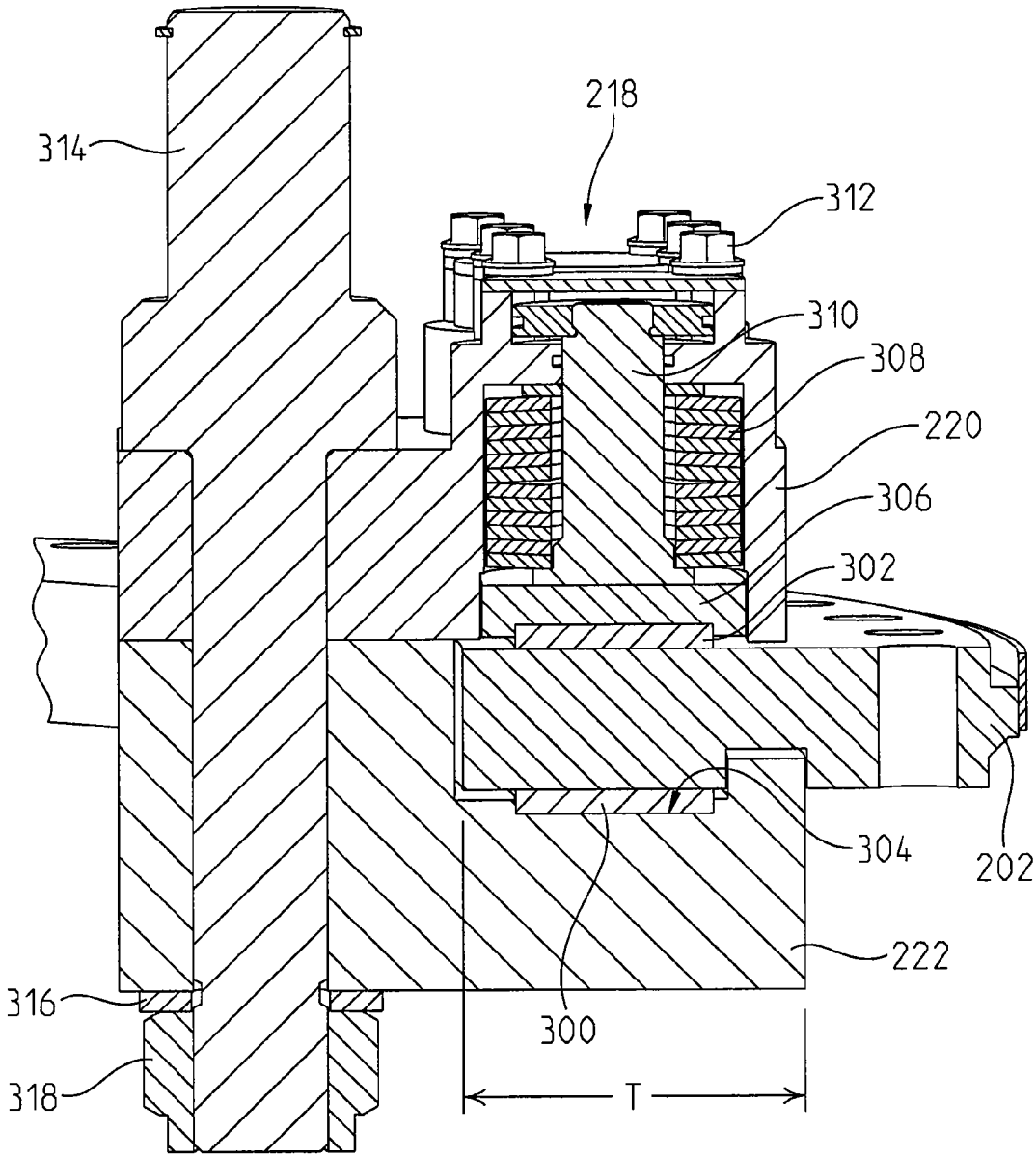
FIG. 3 is a partial cross-sectional view of the exemplary circle drive assembly of FIG. 2.

Turning to FIG. 3, the plurality of coupling mechanisms 218 is shown in greater detail. The first structure 220 and second structure 222 can each include defined openings through which a first fitting 314 and a second fitting 318 can be coupled to one another. A third fitting 316, such as a washer, may be disposed between the first fitting 314 and second fitting 318. The first fitting 314 may comprise a bolt or screw, for example, and the second fitting 318 may comprise a nut. Alternatively, these fittings may comprise any known fitting.

As shown, the circle member 202 can be at least partially surrounded by the first structure 220 and second structure 222. More specifically, a radial thickness T of the circle member 202 can be disposed in contact with either or both the first structure 220 and second structure 222. To accommodate the coupling of the circle member 202 with the first structure 220 and second structure 222, the circle member 202 can include a first raised surface 300 and a second raised surface 302. The first raised surface 300 can be disposed on the opposite side of the circle member 202 from the second raised surface 302. In FIG. 3, for example, the second raised surface 302 is disposed slightly above the top surface of the circle member 202. Similarly, the first raised surface 300 is disposed slightly below the bottom surface of the circle member 202.

The second structure 222 can include a defined recess 304 formed in an upper portion thereof. The first raised surface 300 of the circle member 202 can be disposed in the defined recess 304 of the second structure 222. Moreover, the first structure 220 can include a defined cavity (not shown in detail) in which the plurality of coupling mechanisms 218 is at least partially contained. The second raised surface 302 can protrude into the defined cavity as shown in FIG. 3. In an alternative aspect, the circle member 202 may include a defined recess in its upper and lower surfaces and the first structure 220 and second structure 222 may include raised surfaces that are receivably engaged with the corresponding recesses in the circle member 202. In a further aspect, the circle member 202 may include a defined recess in one of the upper or lower surfaces and a raised portion in the opposite surface. Corresponding structure may be included in the first structure 220 and second structure 222 to facilitate the coupling of the circle member 202 to both the first structure 220 and second structure 222. Other aspects for coupling the circle member 202 to both structures may be possible as known to the skilled artisan.

The plurality of coupling mechanisms 218 can be coupled to the first structure 220 by multiple fasteners 312. The multiple fasteners 312 may be fastened to corresponding openings defined in the first structure 220. Each of the plurality of coupling mechanisms 218 can include a rod member 310, a spring 308 and an apply member 306. When actuated, the rod member 310 can apply a force to the apply member 306 to substantially clamp or couple the first structure 220, second structure 222, and circle member 202 together. When clamped or coupled to one another, the first structure 220, second structure 222, and circle member 202 can be rotationally driven in unison with one another. However, when the circle member 202 is not clamped or coupled to the first structure 220 and second structure 222, the first structure 220 and second structure 222 can move relative to the circle member 202. This can allow the first hydraulic cylinder 206 and second hydraulic cylinder 208, for example, to be decoupled from the circle member 202 and repositioned without moving the circle member 202.

The above-description is related to a single aspect for coupling or coupling the circle member 202 to the first structure 220 and second structure 222. The plurality of coupling mechanisms 218 can be hydraulically actuated. Alternatively, however, the plurality of coupling mechanisms 218 may be electrically actuated, pneumatically actuated, mechanically actuated, electro-mechanically actuated, or actuated in any other known manner. In some aspects, the circle member 202 is clamped by the first and second structures. In other aspects, the circle member 202 may be mechanically coupled via a press-fit engagement, a latch, ratchet, gear mechanism, screw, pin-and-slot configuration, tongue-and-groove configuration, or other means to the first and second structures. It is shown in at least FIG. 2 that the circle member 202 can be rotationally driven by two hydraulic actuators. However, this is only an illustrative embodiment and is not intended to limit the scope of this disclosure. Instead, the circle drive 202 can be rotationally driven by any number of hydraulic cylinders based on size and need. Moreover, it is possible a mechanical actuator or other mechanism can rotationally drive the circle member 202 rather than a hydraulic cylinder.

Figure 4:
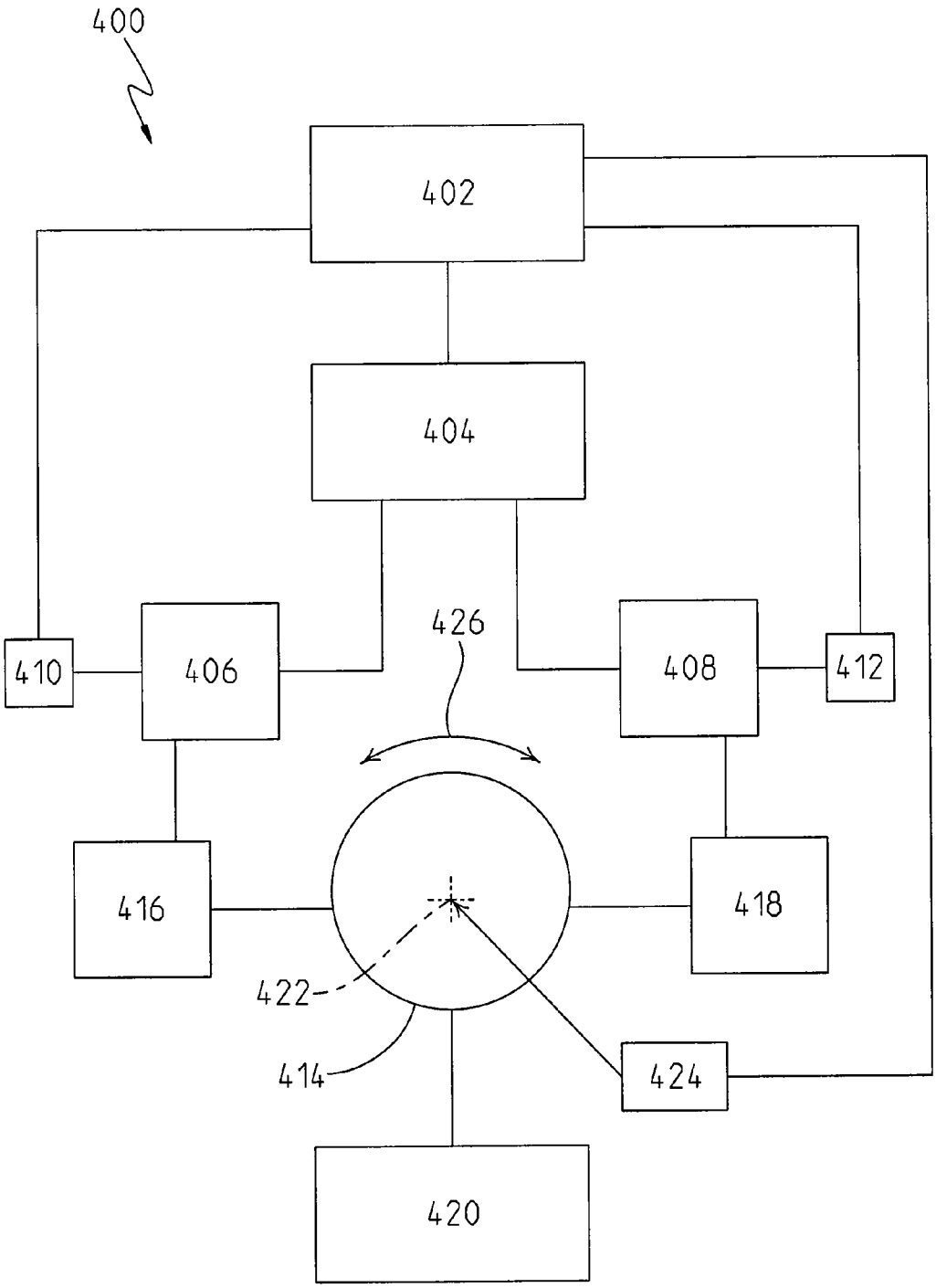
FIG. 4 is a schematic of a control system of an exemplary motor grader.

With reference to FIG. 4, a control system 400 is provided for controlling an exemplary circle drive assembly. The control system 400 can include a machine or vehicle controller 402. The circle drive assembly can include a circle member 414 that is similar to the circle member 202 shown in FIGS. 2 and 3. The circle member 414 can be rotated about a rotation axis 422 in a clockwise or counterclockwise direction 426. The circle member 414 can change the pitch angle of a work implement 420 such as a blade.

The circle member 414 can be rotationally driven by a first hydraulic cylinder 406 and a second hydraulic cylinder 408. In other aspect, there may be three or more cylinders for rotationally driving the circle member 414. The first hydraulic cylinder 406 and second hydraulic cylinder 408 can be disposed in fluid communication with a control valve 404. In one aspect, the control valve 404 can receive fluid from a hydraulic pump (not shown) that is driven by an engine (not shown), and the control valve 404 can transfer fluid to actuate one or both of the hydraulic cylinders.

The first hydraulic cylinder 406 can be coupled to the circle member 414 via a first coupling mechanism 416. Similarly, the second hydraulic cylinder 408 can be coupled to the circle member 414 via a second coupling mechanism 418. The first coupling mechanism 416 and second coupling mechanism 418 can each include a plurality of coupling mechanisms. As the first coupling mechanism 416 and second coupling mechanism 418 are removably coupled, clamped, connected, attached, or otherwise engaged to the circle member 414, further actuation of one or both of the hydraulic cylinders can rotationally drive the circle member 414 about the rotation axis 422 in either a clockwise or counterclockwise direction 426.

When the coupling mechanisms are released from the circle member 414, the circle member 414 is not rotationally driven. Instead, each or both of the first hydraulic cylinder 406 and second hydraulic cylinder 408 can be disengaged from the circle member 414, repositioned to a more desirable position, and then reengaged to the circle member 414 to further rotationally drive and operate the circle drive assembly. This can allow the repositioning of the hydraulic cylinders to provide or achieve better performance from the machine.

To control the positioning of each hydraulic cylinder, a sensing mechanism or rotation sensor 424 can be provided to detect rotational movement of the circle member 414. The sensing mechanism or rotation sensor 424 may comprise one or more switches that detect movement, speed, or position of the circle member 414. The rotational sensor 424 can be electrically coupled to the controller 402 and be in communication or contact with the rotation axis 422 (or the circle member 414 relative to the rotation axis 422). For instance, an armature (not shown) may be in contact with the circle member 414. Alternatively, the sensor 424 may encode the circle member 414 similar to a wheel sensor or crankshaft position sensor and communication position information to the controller 402.

Moreover, a first position sensor 410 can be provided to detect the relative position of the first hydraulic cylinder 406 (e.g., its stroke length). A second position sensor 412 can be provided to detect the relative position of the second hydraulic cylinder 408. The first position sensor 410 and second position sensor 412 can be electrically coupled to the controller 402 to communicate the stroke length or position of each cylinder. In turn, the controller 402 can have a memory unit that stores readable instructions including logic. The controller 402 can adjustably control the control valve 204 to control each hydraulic cylinder. The controller 402 may also be electrically coupled to the first coupling mechanism 416 and second coupling mechanism 418 to induce an engaging or release of the cylinders and circle member 414. In this manner, the controller 402 can control the positioning of the hydraulic cylinders based on feedback signals from the rotation sensor 424, first position sensor 410 and second position sensor 418. In other embodiments, there may be additional hydraulic cylinders with a position sensor for each cylinder.

As the controller 402 receives signals from the rotation sensor 424, the first position sensor 410, and second position sensor 412, it can control the engagement and disengagement of the coupling mechanisms. Moreover, in doing so, the hydraulic cylinders can be repositioned along the circle member 414 to allow the circle member 414 to be rotated 360° or less. Without the controllable engagement and disengagement of the coupling mechanisms, the hydraulic cylinders would not be able to be repositioned thereby limiting the rotation of the circle member (and, ultimately reducing the amount of torque produced by the circle drive assembly). Instead, the coupling mechanisms can be automatically controlled by the controller 402, or a machine operator or technician can manually disengage and reposition the cylinders. Moreover, the coupling mechanisms may couple to the circle member in accordance with any coupling means and is not limited to a coupling movement.

In an alternative aspect, the control system 400 of FIG. 4 may not include a sensing mechanism or rotation sensor 424. Instead, the controller 402 may only receive feedback signals from one or both positions sensors 410, 412. Based on these signals, the controller can control rotational movement of the circle member 414 based on the measured stroke length of each hydraulic cylinder.

In yet another alternative aspect, the control system 400 may not include the position sensors 410, 412. As such, a direct measurement of cylinder rod stroke length may not be known. In one instance, a sensor or other detecting mechanism may be configured to detect or measure the angular positions of the first coupling mechanism 416 and second coupling mechanism 418 relative to the draft frame. In other words, the controller 402 may interpret a defined or threshold angular position, e.g., 0° or 90°, to indicate that the corresponding hydraulic cylinder is at its maximum stroke length, or that for purposes of controlling the movement of the circle member 414 the cylinder rod is at its longest stroke length relative to the draft frame. This may also be the case for any position of either coupling mechanism along the circle member.

Thus, as the cylinder rod stroke length changes and the coupling mechanism moves about the circle member 414, the angular position of the coupling mechanism relative to the defined or threshold angular position changes, and based on the newly detected or measured angular position, the controller 402 may determine an estimated stroke length of the hydraulic cylinder.

Referring to FIG. 2, for example, a sensor or the like may detect that the first hydraulic actuator 206 and second hydraulic actuator 208 are angularly disposed at 45° relative to the draft frame 204. Based on the known length of each cylinder rod of the first hydraulic actuator 206 and second hydraulic actuator 208, the known diameter of the circle member 202, the positioning of the first location 210 and second location 214 relative to the circle member 202, and the detected angles, the controller 402 of FIG. 4 can detect or estimate the stroke length of each hydraulic actuator or cylinder.

In a further instance, a pressure sensing mechanism or device for each hydraulic cylinder can be in electrical communication with the controller 402. In this instance, the controller 402 can interpret or determine when one of the hydraulic cylinders reaches its maximum stroke length based on a pressure spike sensed by the pressure sensing mechanism or device. Here, as the hydraulic cylinder reaches its maximum stroke length and any additional pressure command results in a pressure spike, the controller can interpret or detect that the corresponding hydraulic cylinder is at its maximum stroke length. Other known methods and sensing mechanisms may be incorporated into the control system 400 of FIG. 4 for determining cylinder rod stroke length, position of the circle member relative to the rotation axis, or both.

While exemplary embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A circle drive assembly for a motor grader, comprising:

a circle member being rotatable about a rotation axis, the circle member adapted to adjustably control a work implement;

a first hydraulic cylinder for rotatably driving the circle member, the first hydraulic cylinder having a first end;

a second hydraulic cylinder for rotatably driving the circle member, the second hydraulic cylinder having a second end;

a first coupling mechanism coupled to the first end of the first hydraulic cylinder, where the first coupling mechanism is controllably moved between a coupled position and an uncoupled position, the first end coupled to the circle member via the first coupling mechanism when the first coupling mechanism is in the coupled position, the first end uncoupled from the circle member and moveable relative to the circle member when the first coupling mechanism is in the uncoupled position; and a second coupling mechanism coupled to the second end of the second hydraulic cylinder, where the second coupling mechanism is controllably moved between a coupled position and an uncoupled position, the second end coupled to the circle member via the second coupling mechanism when the second coupling mechanism is in the coupled position, the second end uncoupled from the circle member and moveable relative to the circle member when the second coupling mechanism is in the uncoupled position;

wherein the first hydraulic cylinder rotatably drives the circle member when the first coupling mechanism is in the coupled position and the second hydraulic cylinder rotatably drives the circle member when the second coupling mechanism is in the coupled position.

2. The circle drive assembly of claim 1, wherein each of the first coupling mechanism and second coupling mechanism comprises a plurality of calipers.

3. The circle drive assembly of claim 1, wherein each coupling mechanism is hydraulically controlled between the coupled and uncoupled positions.

4. The circle drive assembly of claim 1, wherein the first end and second end are structured to move in a circular manner relative to the rotation axis as the first and second hydraulic cylinders are actuated.

5. The circle drive assembly of claim 1, wherein:

the first end is structured to move relative to the circle member from a first location to a second location along a circumference of the circle member when the first coupling mechanism is in the uncoupled position; and the second end is structured to move relative to the circle member from a third location to a fourth location along the circumference of the circle member when the second coupling mechanism is in the uncoupled position.

6. The circle drive assembly of claim 1, wherein the circle member is structured to be rotatably driven in a clockwise or counterclockwise direction.

7. The circle drive assembly of claim 1, wherein the first coupling mechanism comprises a first structure and a second structure coupled to one another, the first structure being disposed at least partially above the circle member and the second structure being disposed at least partially beneath the circle member, where the circle member includes a first raised portion that is accommodated within a recess defined in the second structure when the first coupling mechanism is in at least the coupled position.

8. A motor grader, comprising:

a frame for supporting a plurality of wheels;

a work implement supported by the frame and adapted to perform a desired operation;

a controller;

a circle drive assembly for controlling the work implement, the circle drive assembly including:

a circle member being rotatable about a rotation axis;

a first hydraulic cylinder for rotatably driving the circle member, the first hydraulic cylinder having a first end coupled to the frame and a second end opposite the first end;

a second hydraulic cylinder for rotatably driving the circle member, the second hydraulic cylinder having a first end coupled to the frame and a second end opposite the first end;

a first coupling mechanism coupled to the second end of the first hydraulic cylinder, the first coupling mechanism controllably actuated between an engaged position and a disengaged position, the second end of the first hydraulic cylinder engaged with the circle member via the first coupling mechanism when the first coupling mechanism is in the engaged position, the second end of the first hydraulic cylinder disengaged from the circle member and moveable relative to the circle member when the first coupling mechanism is in the disengaged position; and a second coupling mechanism coupled to the second end of the second hydraulic cylinder, the second coupling mechanism controllably actuated between an engaged position and a disengaged position, the second end of the second hydraulic cylinder engaged with the circle member via the second coupling mechanism when the second coupling mechanism is in the engaged position, the second end of the second hydraulic cylinder disengaged from the circle member and moveable relative to the circle member when the second coupling mechanism is in the disengaged position;

wherein, the first hydraulic cylinder rotatably drives the circle member when the first coupling mechanism is in the engaged position and the second hydraulic cylinder rotatably drives the circle member when the second coupling mechanism is in the engaged position.

9. The motor grader of claim 8, further comprising:

a sensing mechanism electrically coupled to the controller, the sensing mechanism adapted to detect rotational movement of the circle member;

a first position sensor electrically coupled to the controller, the first position sensor adapted to detect a stroke length and position of the first hydraulic cylinder; and a second position sensor electrically coupled to the controller, the second position sensor adapted to detect a stroke length and position of the second hydraulic cylinder;

wherein, the controller is structured to receive electrical signals from the sensing mechanism, first position sensor, and second position sensor, and based on said signals, actuate one or both of the first and second coupling mechanisms.

10. The motor grader of claim 8, wherein the second end of the first hydraulic cylinder is structured to move in a circular manner relative to the rotation axis as the first hydraulic cylinder is actuated and the second end of the second hydraulic cylinder is structured to move in a circular manner relative to the rotation axis as the second hydraulic cylinder is actuated.

11. The motor grader of claim 8, wherein each of the first coupling mechanism and second coupling mechanism comprises a plurality of calipers.

12. The motor grader of claim 8, wherein:

the second end of the first hydraulic cylinder is structured to be moved relative to the circle member from a first location to a second location along a circumference of the circle member when the first coupling mechanism is in the disengaged position; and the second end of the second hydraulic cylinder is structured to be moved relative to the circle member from a third location to a fourth location along the circumference of the circle member when the second coupling mechanism is in the disengaged position.

13. The motor grader of claim 8, wherein the first coupling mechanism comprises a first structure and a second structure coupled to one another, the first structure being disposed at least partially above the circle member and the second structure being disposed at least partially beneath the circle member, where the circle member includes a first raised portion that is accommodated within a recess defined in the second structure when the first coupling mechanism is in at least the engaged position.

14. A method for operably controlling a circle drive assembly coupled to a frame of a motor grader, the circle drive assembly being coupled to a frame of the motor grader and including a circle member rotatable about a rotation axis, a first hydraulic cylinder having a first end, a second hydraulic cylinder having a second end, a first coupling mechanism coupled to the first end, a second coupling mechanism coupled to the second end, and a sensing mechanism, the method comprising:

detecting a position of the circle member relative to the rotation axis, a stroke length of the first hydraulic cylinder, or a stroke length of the second hydraulic cylinder with a sensing mechanism;

communicating an electrical signal to a vehicle controller based on the detected position of the circle member or stroke length of either hydraulic cylinder;

coupling at least one of the first coupling mechanism and second coupling mechanism to the circle member;

actuating at least one of the first hydraulic cylinder and second hydraulic cylinder to rotatably drive the circle member about the rotation axis;

uncoupling at least one of the first coupling mechanism and second coupling mechanism from the circle member; and moving at least one of (i) the first end relative to the circle member when the first coupling mechanism is uncoupled and (ii) the second end relative to the circle member when the second coupling mechanism is uncoupled.

15. The method of claim 14:

wherein the detecting step further comprises:

detecting the position of the circle member relative to the rotation axis with a rotation sensor;

detecting the stroke length of the first hydraulic cylinder with a first position sensor; and detecting the stroke length of the second hydraulic cylinder with a second position sensor;

further wherein:

if either the first coupling mechanism or the second coupling mechanism is in a desired position, the first coupling mechanism or second coupling mechanism is coupled to the circle member at the desired position; and if either the first coupling mechanism or the second coupling mechanism is in an undesired position, the first coupling mechanism or second coupling mechanism is moved from the undesired position to the desired position and then coupled to the circle member at the desired position.

16. The method of claim 14, further comprising:

receiving an electrical signal from the vehicle controller;

coupling the first coupling mechanism and the second coupling mechanism to the circle member; and rotatably moving the circle member about the rotation axis by the first hydraulic cylinder and the second hydraulic cylinder.

17. The method of claim 14, further comprising:

receiving an electrical signal from the vehicle controller;

uncoupling the first coupling mechanism from the circle member; and moving the uncoupled first coupling mechanism from a first location to a second location along the circle member;

wherein, the uncoupled first coupling mechanism moves relative to the circle member.

18. The method of claim 14, further comprising:

(a) coupling the first coupling mechanism and second coupling mechanism to the circle member;

(b) rotating the circle member about the rotation axis an angular distance less than 360';

(c) uncoupling at least one of the first and second coupling mechanisms from the circle member;

(d) repositioning the at least one uncoupled coupling mechanism about the circle member; and (e) repeating steps (a)-(d) one or more times to rotatably move the circle member about the rotation axis in a clockwise or counterclockwise direction.

* * * * *